US005186459A

United States Patent [19]

Korte-Jungermann

[11] Patent Number: 5,186,459

[45] Date of Patent: Feb. 16, 1993

[54] PROCESS FOR STRINGING RACKETS FOR BALL GAMES AND A DEVICE FOR CARRYING OUT THE PROCESS

[76] Inventor: Hans-Werner Korte-Jungermann, Klein Kollenburg Strasse 58, D-4156 Willich 2(DE), Fed. Rep. of Germany

[21] Appl. No.: 671,876

[22] PCT Filed: Oct. 16, 1989

[86] PCT No.: PCT/DE89/00655

§ 371 Date: Jun. 6, 1991

§ 102(e) Date: Jun. 6, 1991

[87] PCT Pub. No.: WO90/03829

PCT Pub. Date: Apr. 19, 1990

[30] Foreign Application Priority Data

Oct. 15, 1988 [DE] Fed. Rep. of Germany ..... 3835192

[51] Int. Cl.[5] ..... A63B 51/14

[52] U.S. Cl. ..... 273/73 A; 273/73 B; 273/73 D

[58] Field of Search ..... 273/73 R, 73 A, 73 B, 273/73 C, 73 D

[56] References Cited

U.S. PATENT DOCUMENTS 2,091,654 8/1937 Roberts et al. ..... 273/73 B
3,994,495 11/1976 Stoffel ..... 273/73 A X
4,125,259 11/1978 Halbrook ..... 273/73 A
4,140,316 2/1979 Coupar ..... 273/73 A
4,249,732 2/1981 Balaban ..... 273/73 A
4,333,649 6/1982 Vaugh et al. ..... 273/73 D
4,373,721 2/1983 Ray ..... 273/73 A
4,484,742 11/1984 McCrone et al. ..... 273/73 A
4,491,322 1/1985 Heilman ..... 273/73 A
4,949,968 8/1990 Korte-Jungermann ..... 273/73 A

FOREIGN PATENT DOCUMENTS 2928748 1/1981 Fed. Rep. of Germany ... 273/73 A
427587 4/1935 United Kingdom ..... 273/73 A

*Primary Examiner*—V. Millin
*Assistant Examiner*—Raleigh W. Chiu
*Attorney, Agent, or Firm*—Mason, Kolehmainen, Rathburn & Wyss

[57] ABSTRACT

Described is a process for stringing rackets for ball games, in particular tennis, with individual strings, and a tensioning device which is suitable for that purpose. Instead of the individual string which is introduced into the racket and arrested at one edge of the racket being gripped for the purposes of applying the required tensile force at the smooth individual string by means of clamping jaws, the tensile force is applied to a thickening on the string. In that way the individual string can be gripped and tensioned substantially more easily than hitherto. A suitable tensioning device for that purpose is also described.

8 Claims, 2 Drawing Sheets

PROCESS FOR STRINGING RACKETS FOR BALL GAMES AND A DEVICE FOR CARRYING OUT THE PROCESS

BACKGROUND OF THE INVENTION

1. Field of the Invention

The invention relates to a process for stringing rackets for ball games, in particular tennis, with individual strings, and a device for carrying out that process.

2. Background of the Prior Art

German utility model No. G 86 24 960 discloses a device for stringing rackets with individual strings, comprising a contact portion which can be fitted on to the rim of the racket and a holding portion which is provided to bear against the inside edge of the racket, together with a tensioning means with a clamping means for holding the string fast. There is also provided a measuring device for indicating the tension attained, and a device for clamping the rivet sleeve fast when the string is tensioned.

That arrangement suffers from the disadvantage that the individual string to be tensioned which is introduced from the opposite side of the rim of the racket, crossing the possibly existing string, and which is fixed on the opposite side of the rim of the racket, must be passed through the tensioning head of the tensioning device in order to apply the tensile tensioning force which is done by means of clamping jaws. That operation which can be referred to as the "threading-in operation" suffers from disadvantages in the context of practical operation for the procedure for stringing a racket with individual strings is intended inter alia to make it possible for the tennis player who has suffered a broken string to renew that string on the spot.

OBJECTS OF THE INVENTION

The invention is based on the problem of proposing a process for stringing rackets for ball games, in particular tennis rackets, with individual strings, and a device which is suitable for that purpose, permitting operation which is as simple as possible.

BRIEF SUMMARY OF THE PRESENT INVENTION

To solve that problem, the process according to the invention proposes the process steps recited in the characterizing portion of the claims. The fact that the tensile force is now applied to a thickening on the individual string means that there is no need for the troublesome operation of threading in the string, which was required in accordance with the previous process, as the tensile force can be applied by engagement of a claw or the like on the thickening. The thickening is therefore not clamped but is loosely mounted in the claw element. When the tensile force is applied, no damage is done to the individual string by clamping elements and the individual string can rotate by virtue of the initially loose contact thereof in the claw, before the tensile force is applied.

The thickening may be provided from the outset in an end region or at an end of the individual string. It is then necessary for a rivet sleeve firstly to be pushed on to the string, prior to the individual string being introduced into the racket, in such a way that the rivet head of the rivet sleeve is towards the thickening. Then, a rivet sleeve is clamped in position on the individual string on the "oppositely disposed" outward side of the racket, then the tensile force is applied to the thickening, the rivet sleeve which had been previously fitted on to the string is clamped fast and then the tensile force is reduced so that the rivet sleeve which is now fixed in position slips into the bore due to the tension which still remains until the rivet head bears against the edge of the bore and thus the string is tensioned. It is then only necessary to cut off the end of the individual string which has the thickening.

It will be appreciated that it is alternatively also possible for an individual string without thickening to be first introduced, and then arrested at one edge of the racket. The loose rivet sleeve is then firstly pushed on to the free end of the string which projects outwardly on the then oppositely disposed side, and then a thickening is applied, for example by clamping a corresponding element thereon. That element clamped on the string can then also be gripped with a forked claw for applying the tensile force.

A device for carrying out the process is characterized by the features recited in the apparatus claims. In that connection it is advantageous that the thickening of the individual string to which the tensile force is to be applied can be engaged by the claw of the tensioning device, and that the tensioning device can then be fitted on to the frame of the racket, in which case the abutment bears against the outside edge of the racket. The tensioning device is then locked in position by means of the arresting element which can be for example in the form of a pin. As the claw and the arresting element lie on respective oppositely disposed sides of the abutment which is provided to bear against the outside edge, a certain tensioning in the string can already be achieved by engaging the thickening on the individual string with the claw and by applying the abutment against the outside edge of the racket. The user can then pivot the tensioning device against the force of the achieved tensioning in the string, more specifically to such an extent until the receiving means for receiving the arresting element lie on the inward side of the rim of the racket so that the arresting element, for example the pin, can then be passed through. Further tension has thus been applied to the individual string. In terms of practical use that has the substantial advantage that the string to be tensioned does not slip away from the user during the step of fixing the tensioning device to the rim of the racket.

In an advantageous configuration of the invention it is provided that the claw is arranged movably against a prestressing force in a sleeve which is mounted loosely pivotably in the tensioning lever. That has the advantage that the claw can suitably adapt to the angle of inclination which varies when the tensioning device is fitted and when the tensioning force is adjusted. The prestressing force is desirably produced by a prestressing spring. The respectively set tensioning force can be indicated by a force indicator means.

A further embodiment of the invention provides that the adjusting device has a self-locking spindle-gear arrangement.

BRIEF DESCRIPTION OF THE DRAWINGS

The invention is described in greater detail hereinafter with reference to the drawings in which.

DETAILED DESCRIPTION OF A PREFERRED EMBODIMENT

Figure 1:
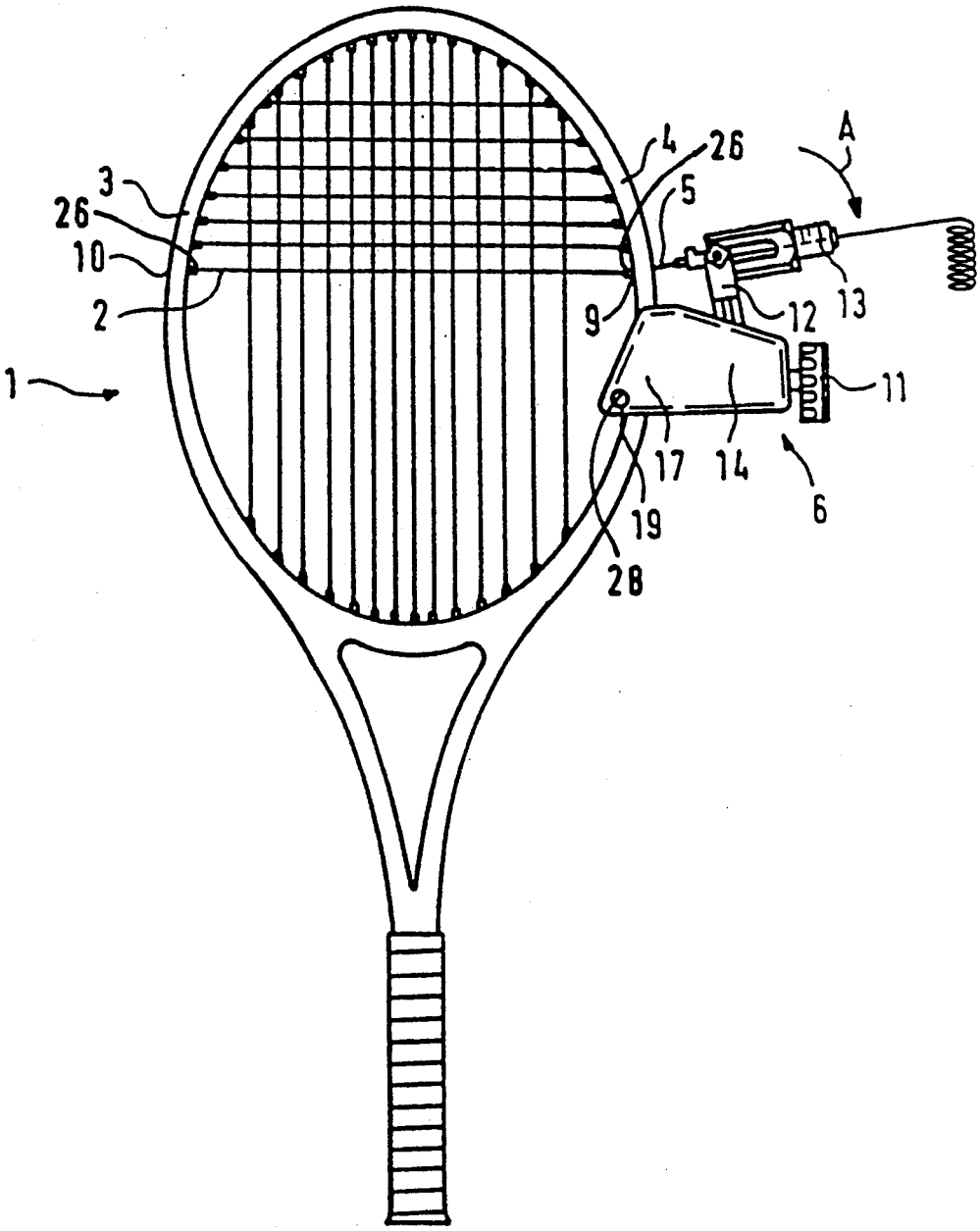
FIG. 1 is a plan view of a racket with a number of strung individual strings and the tensioning device.

A racket which is generally identified by reference numeral 1 comprises in its head stringing with individual strings which are each arranged to cross each other. FIG. 1 only identifies one individual string, more especially at reference numeral 2. The individual string 2 is shown in a position in which it is fixed in the edge 3 of the racket on the left-hand side in FIG. 1, while on the oppositely disposed side it sticks out with its free end 5 through the edge of the racket which is identified thereby reference numeral 4. The end 5 has a thickening 5*a* (FIG. 2) which can be for example in the form of a ball 5*b* (FIG. 3), a rivet sleeve clamped on the string or the like, in such a way that the thickening can be engaged by a claw of the tensioning device 6. The claw is identified by reference numeral 7 in FIGS. 2 and 3.

Figure 2:
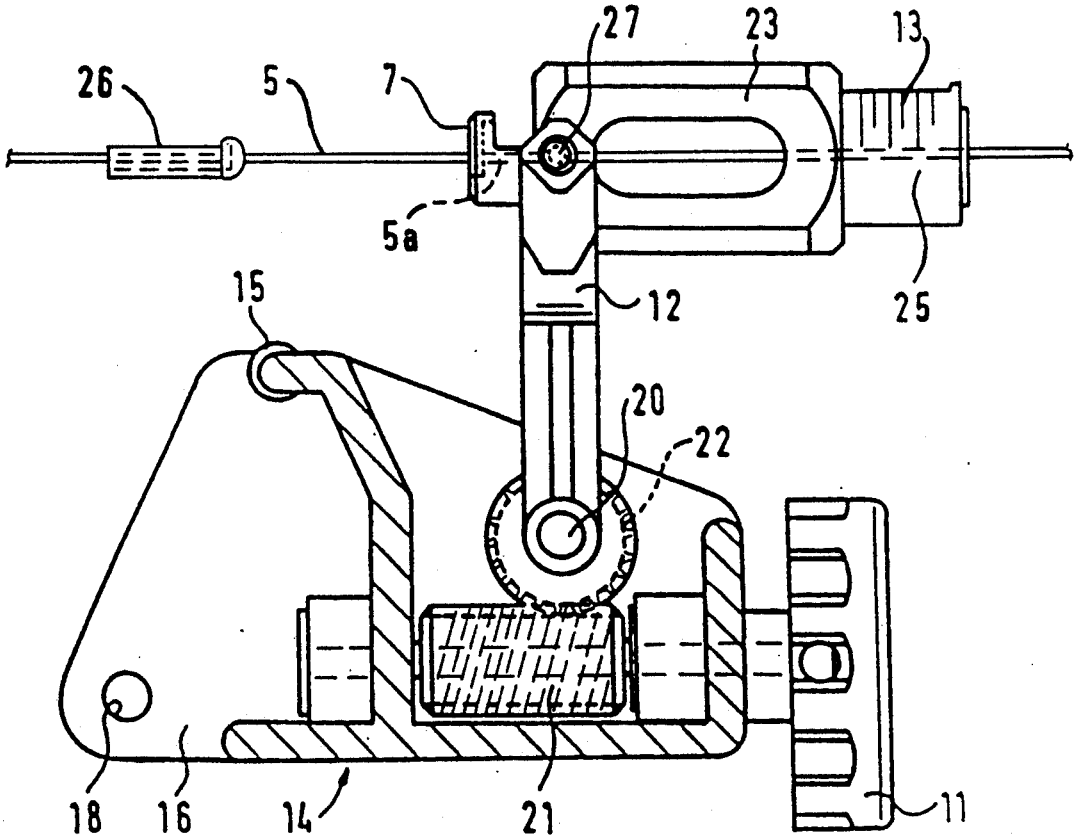
FIG. 2 is a partial sectional view through the tensioning device on an enlarged scale.
Figure 3:
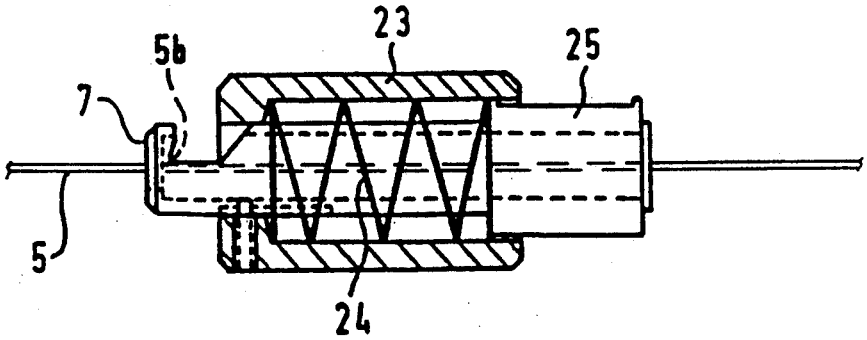
FIG. 3 is a view in section through the sleeve which is loosely pivotably mounted in the tensioning lever of the tensioning device.

Before the individual string 2 in FIG. 1 has reached the position illustrated therein, the following process steps have taken place:

The individual string 2 has the above-mentioned thickening (5*a*, 5*b*) at its end 5. Before the individual string is introduced into the racket, a first rivet sleeve 26 which may be of the type shown in applicant's U.S. Pat. No. 4,949,968, is pushed on to the string 2 from the oppositely disposed side in such a way that the rivet head of the rivet sleeve is towards the thickening (FIG. 2). The left-hand end portion of the individual string 2 on the side remote from the thickening 5*a* was then introduced from the outside through a bore 9 in the edge 4 of the racket and passed over and under the strings extending transversely therethrough and passed through a bore 10 into the opposite edge 3 of the racket. A second rivet sleeve 26 was then pushed on to the left-hand end of the string which then projects outwardly beyond the edge 3 of the racket as shown in FIG. 1, and the rivet sleeve was then clamped fast on the individual string 2 by means of a clamping device. The string 2 was then pulled from the end 5 whereby the rivet sleeve which had just been fixed in position slipped into the bore 10. The bores in the rim of the racket and the rivet sleeves are so matched to each other in terms of their size that the rivet sleeve can engage into the bore while the head of the rivet sleeve bears against the edge of the bore, thereby producing an arresting action.

The left-hand end of the individual string 2, which possibly projects beyond the second rivet head, was then cut off.

FIG. 1 shows the position in which the free end 5 of the individual string 2 was now engaged by a tensioning device 6. The tensioning device 6 sits on the edge 4 of the racket. By rotation of a hand wheel 11, a tensioning lever 12 can be pivoted in the direction indicated by the arrow A. As will be readily apparent, a tensioning force is thereby applied to the individual string 2. The magnitude of the tensioning force applied can be read off on a scale 13. When the applied tensioning force has reached the desired magnitude, the riveting sleeve 26 (FIG. 2) which is disposed in the region between the outside edge 4 of the racket and the thickening (5*a*) engaged by the claw is clamped fast by means of a clamping device (not shown) which can be in the form of a kind of rivet tongs assembly. The tensioning force is then reduced by turning the hand wheel 11 and the resulting pivotal movement of the tensioning lever 12 in the opposite direction to that indicated by the arrow A, more particularly until the rivet sleeve which has just been clamped fast in position has been drawn into the bore 9 by the tensioning force which still exists, until the rivet head of that rivet sleeve bears against the edge of the bore 9. It is then only necessary to cut off the end 5 of the individual string 2, which projects beyond the rivet head and which has the thickening.

The magnitude of the tensile force applied by the tensioning device 6 is so selected that the tensioning force on the string in the finished condition corresponds to the desired string tension.

On a body 14 the tensioning device comprises an abutment 15 which is provided to bear against the outside edge of the racket 1. The device also has flanks 16 and 17 which are of such a configuration that they can engage over the edge 4 of the racket. Provided in the flanks 16 and 17 are receiving means in the form of holes 18 and 19 for receiving an arresting element which is for example in the form of a pin 28. In that way the tensioning device can be easily fitted on to the edge of the racket from the outside in such a fashion that the abutment 15 bears against the outside edge and the arresting element passes through the receiving means 18 and 19 and then the arresting element bears against the inside edge.

The above-mentioned tensioning lever 12 is mounted in the body 14 pivotably at 20 and is pivotable about the pivot pin 20 by way of a spindle 21 which can be rotated by rotation of the hand wheel 11, and a gear assembly 22. At its free end the tensioning lever 12 has a sleeve 23 which is pivotably mounted in the tensioning lever 12, on a pivot pin 27. The claw 7 which serves to receive the thickening of the individual string to be tensioned is movable in the sleeve 23 against the prestressing of a spring 24. Connected to the claw 7 is a force indicator means 25 which carries a measurement scale 30 (FIG. 2).

When the individual string 2 has reached the position shown in FIG. 1 (in which it is not yet engaged by the tensioning device), the user takes the tensioning device which is at that time not connected to the racket and firstly engages the thickening at the free end 5 of the individual string 2 by means of the claw 7. The user then applies the tensioning device with the abutment 15 against the outside of the edge 4 of the racket. If the thickening does not project too far outwardly, a tensioning force, even if slight, is thereby already applied to the individual string 2, which however is sufficient to prevent the thickening coming out of the claw 7 again.

The flanks 16 and 17 are then fitted over the edge of the racket and then the arresting element is introduced into the receiving means 18 and 19. In the pivotal movement involved therewith of the tensioning device about the point of contact of the abutment 15 against the racket, further tensioning is applied to the individual string 2. The desired tension is then set for the string at the hand wheel 11. Desirably the situation is such that the value to be read off at the measuring scale 30 corresponds to the tensile force which is ultimately desired. That means that the value actually applied by the tensioning device must be correspondingly higher. After the rivet sleeve which is loosely carried on the free end 5 of the string between the outside edge of the racket and the thickening is clamped fast, the tension in the string is then reduced until the rivet sleeve has slipped into the bore 9. The projecting end 5 is then cut off and the tensioning device is released again.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Apparatus for stringing a racket having a frame with aligned opposing bore holes on opposite sides of said frame with a string having a thickened portion thereon spaced outside of said racket frame on a first side of said frame after said string has been passed through said aligned bore holes, passed over and under any strings which may already be strung in the face of the racket transverse thereto and secured to a second side of said frame;

said apparatus including:

a base adapted to be detachably secured on said first side of said racket frame adjacent said bore hole therein;

a claw supported for pivotal movement on said base for engaging a thickened portion formed on said string to exert tension on said string in a direction outwardly of said racket frame when said claw is pivoted relative to said frame; and control means for pivotally moving said claw on said base to increase and decrease tension exerted on said string by said claw engaging said thickened portion.

2. The stringing apparatus of claim 1, wherein:

said control means includes a lever pivotally interconnected with said claw and pivotally mounted on said base for movement toward and away from said first side of said racket frame.

3. The stringing apparatus of claim 2, wherein:

said control means includes a hollow guide sleeve pivotally mounted on said lever away from said base;

said claw including a stem portion extending away from said first side of said racket frame slidably mounted in said hollow guide sleeve for movement toward and away from said first side of said racket frame.

4. The stringing apparatus of claim 3, including:

biasing means in said hollow guide sleeve for urging said claw away from said first side of said racket frame to apply tension on said string.

5. The stringing apparatus of claim 4, including:

an indicator on said stem portion of said claw for indicating the amount of tension on said string material engaged by said claw.

6. The string apparatus of claim 2, wherein:

said control means includes a worm gear for pivoting said lever on said base to control the tension applied by said claw to said thickened portion on said string.

7. A process of stringing a racket having a frame with aligned, string receiving opposing bore holes on opposite sides of said racket frame, comprising the steps of:

sliding a first one of a pair of hollow sleeves having a head at one end, headed end first, onto a leading end portion of string material supplied from a continuing source;

feeding said leading end portion of said string material from a region exteriorly of said racket through a bore hole on a first side of said racket frame from an outside surface of said frame toward an inside surface of said frame;

thereafter threading said leading end portion over and under any strings which may already have been strung in the face of the racket and which are extended transverse to said leading end portion;

thereafter feeding said leading end portion of said string material from an inside surface toward an outside surface of said racket frame through an opposed bore on an opposite, second side of said frame until an outer end of said leading end portion of said string material extends outwardly of said outside surface of said second side of said racket frame;

sliding a second one of said pair of said hollow sleeves, headed end facing outwardly away from said racket frame onto said outer end of said leading end portion of said string material from a region exteriorly of said racket frame;

securely attaching said second sleeve to said string material by compression of said second sleeve on said string material;

severing any excess string material of said end portion thereof that is still remaining outwardly of said racket frame beyond said headed end of said second sleeve exteriorly of said racket frame;

seating said second sleeve in said bore in said opposite second side of said racket frame by applying tension on said stringing material from a region exteriorly of said first side of said racket frame so that said headed end of said second sleeve serves to secure said string material to said second side of said racket frame;

thickening a portion of said string material extending outwardly of said headed end of said first sleeve at a region exteriorly of said racket frame from said first side of said frame;

gripping said string material with a claw at a region between said first sleeve and an adjacent end of said thickened portion and outwardly directing tension on said string material to a measured magnitude of tension force;

securely attaching said first sleeve to said string material by compression of said sleeve on said string material;

thereafter relaxing some of said tension on said string material applied by said claw so that said first sleeve will seat in said bore on said first side of said racket frame because of the force of the remaining tension in said string material thereby maintaining said headed end of said first sleeve against said first side of said frame; and thereafter severing any portion of said string material projecting outwardly beyond the headed end of said first sleeve seated in said bore on said first side of said racket frame.

8. The stringing process according to claim 7 characterized in that:

during the step of feeding said leading end portion of said string material into said opposing bore holes on opposite sides of said racket frame in a condition wherein said leading end portion does not initially have a portion formed by thickening of said string material; and that after said second sleeve is seated in said bore of said opposite second side of said racket frame said thickening portion is formed on said string material by clamping a pinching element thereon.

* * * * *